United States Patent [19]

Barabas

[11] Patent Number: 4,590,630

[45] Date of Patent: May 27, 1986

[54] TRI-FOLD MECHANISM

[75] Inventor: John Barabas, New Hyde Park, N.Y.

[73] Assignee: Castro Convertibles Corporation, New York, N.Y.

[21] Appl. No.: 699,206

[22] Filed: Feb. 5, 1985

[51] Int. Cl.[4] ..... A47C 17/04

[52] U.S. Cl. ..... 5/13; 5/29; 5/31

[58] Field of Search ..... 5/13, 14, 28, 29, 30, 5/31, 32 R, 33, 32 B, 35, 36, 313 R

[56] References Cited

U.S. PATENT DOCUMENTS

| | | | |
|---|---|---|---|
| 3,292,188 | 12/1966 | Gerth | 5/13 |
| 3,503,081 | 3/1970 | Mikos | 5/13 |
| 4,080,692 | 3/1978 | Eakins | 5/13 |
| 4,200,941 | 5/1980 | Gill et al. | 5/13 |
| 4,301,559 | 11/1981 | Geenberghe | 5/13 |
| 4,398,312 | 8/1983 | Duff | 5/13 |
| 4,439,878 | 4/1984 | Stevens | 5/29 |

FOREIGN PATENT DOCUMENTS

| | | | |
|---|---|---|---|
| 1515226 | 1/1968 | France | 5/13 |
| 619080 | 3/1961 | Italy | 5/13 |

*Primary Examiner*—John E. Murtagh
*Assistant Examiner*—Richard E. Chilcot, Jr.
*Attorney, Agent, or Firm*—Pasquale A. Razzano

[57] ABSTRACT

A convertible sofa-bed is disclosed which has a seating area, a back rest, and a mechanism support frame located below the seating area. A folding mechanism for supporting a mattress when the mechanism is unfolded and for supporting a seat in the seating area when folded with the mechanism located within the frame below the seat is also provided. The mechanism has first, second and third main sections, a fourth auxiliary section pivotally interconnecting the first and second sections, a fifth auxiliary section pivotally interconnecting the second and third sections, and a linkage mechanism operatively engaged with the third section for supporting the mechanism in the support frame. An additional linkage mechanism permits the three main sections to be folded over one another in an overlapping generally parallel relationship, so that the entire mechanism can be supported within the frame below the seating area of the sofa-bed.

7 Claims, 5 Drawing Figures

10
12
14
16
18
20
22
24
30
32
34
35
36
40
46
50
54
56
58
60
62
64
66
68
70
72
74
76
78
79
81
82
84
86
90
92
96
98
100
102

FIG. 4
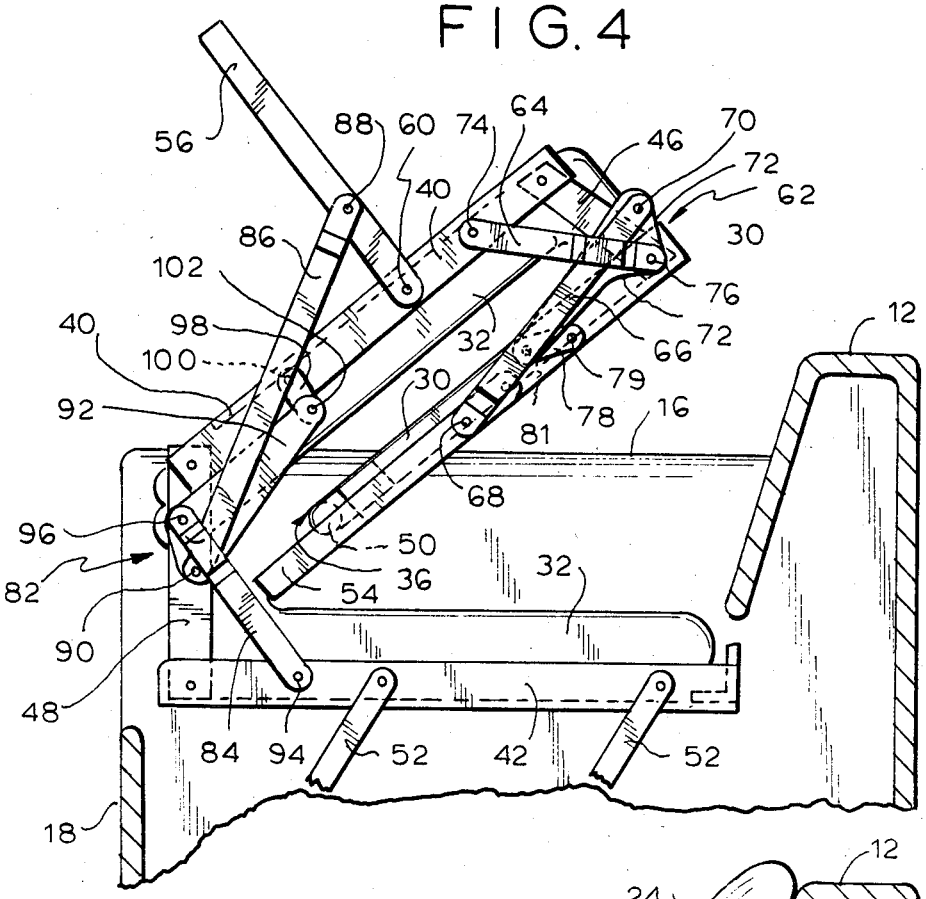
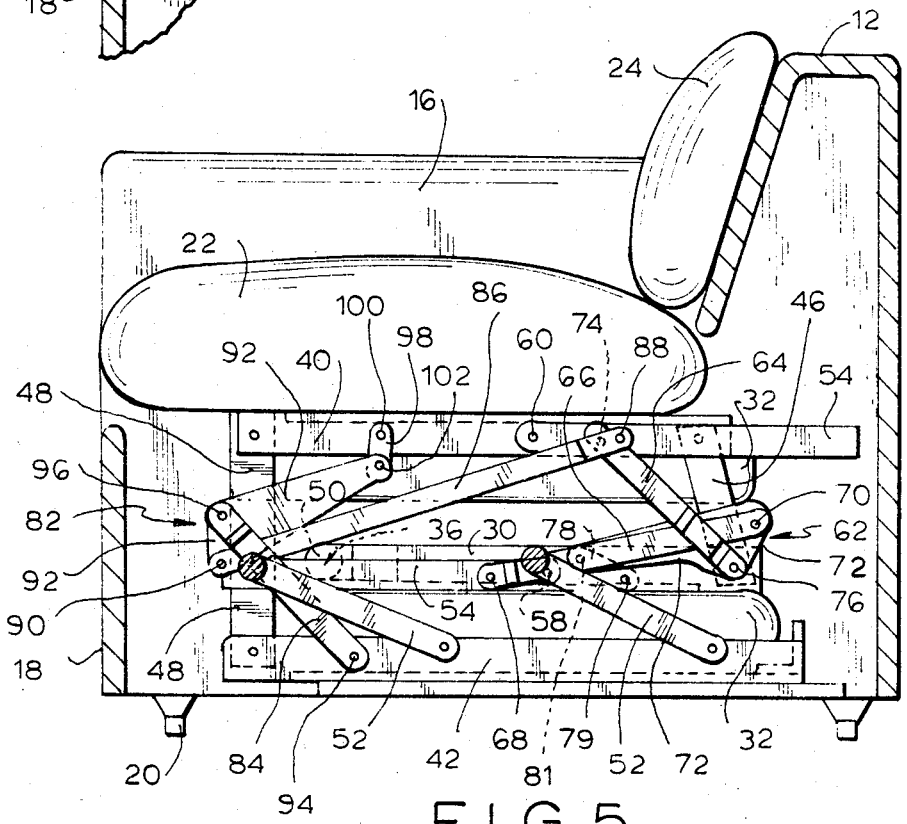
FIG. 5

TRI-FOLD MECHANISM

BACKGROUND OF THE INVENTION

The present invention relates to convertible sofa-beds and more particularly to a convertible sofa-bed mechanism which has a low profile when the mechanism is folded.

A consistent problem with conventional sofa-bed mechanisms is that the mechanism is very complex in operation and requires a substantial amount of space within the sofa-bed frame. As a result, the seating surface of the sofa is often higher than is normal for a conventional sofa without a bed mechanism in it. In addition, it is desirable that these mechanisms be relatively easy to operate, despite their complexity.

In many previously proposed sofa-bed mechanisms, the mechanism has multiple sections including a section which, in the folded condition of the mechanism, moves up into the back of the sofa in an attempt to reduce space usage beneath the seating surface. While such mechanisms have been successful they add additional complexity to the sofa mechanism and still do not achieve the desirable compactness that is necessary in order to simulate conventional sofa seating heights.

OBJECTS OF THE INVENTION

An object of the present invention is to provide a convertible sofa-bed mechanism which is relatively easy to operate and inexpensive to manufacture.

Yet another object of the present invention is to provide a sofa-bed mechanism which, when folded, provides a relatively soft seat platform for the seat cushion of the sofa at a normal seating height.

Yet another object of the present invention is to provide a sofa-bed mechanism which is relatively simple in manufacture and construction yet durable in use.

A further object of the present invention is to provide a simple sofa-bed mechanism suitable for use with an air inflatable mattress.

SUMMARY OF THE INVENTION

In accordance with an aspect of the present invention, a convertible sofa-bed mechanism is provided which includes a support frame and a folding mechanism for supporting a mattress when unfolded and for supporting a seat when folded, with the mechanism located within the sofa frame below the seat only. The folding mechanism has first, second and third main sections, with a shorter fourth section pivotally interconnecting the first and second sections and another short, fifth, section pivotally interconnecting the second and third sections. Support linkage means are provided for moveably supporting the third frame section within the frame for movement between a first unfolded position of the mechanism and a second lower folded position within the frame.

Legs are respectively pivotally connected to the first and second sections and a linkage mechanism for folding and unfolding the frame sections is provided. The linkage mechanism includes a pair of sub-linkages each of which includes first and second control links extending generally parallel to, but offset from, each other in the unfolded position of the mechanism and crossing each other in the folded position. A control plate is associated with each of the sub-linkages. The first control link in one of the pairs is pivotally connected at one end to the leg of the first section and at its other end to its associated control plate in proximity to the fourth section. The second control link of that pair is pivotally connected at one end to its associated control plate such that in the unfolded position of the mechanism the one end thereof is below the first link and closer to the leg of the first section than the other end of the first link.

The first control link in the other of the pairs of sub-linkages is pivotally connected at one end to the leg of the second section and at its other end to its associated control plate in proximity to the fifth section. The second control link of that pair is pivotally connected at one end to its associated control plate such that in the unfolded position of the mechanism the one end thereof is below the first link and closer to the leg of the second section than the other end of the said first link.

The sub-linkages each also include and over-the-center link respectively pivotally connected at one end to the first and second sections between their associated legs and the pivotal connections of the fourth and fifth sections to the first and second sections. The opposite ends of the over-the-center links are respectively connected to the control plates of their respective sub-linkages such that in the unfolded position of the mechanism the points of connection of the over-the-center links and their associated control plates are located between and above the points of connection of the over-the-center links and their respective sections and shorter sections. As a result initial pivotal movement of the first section about its connection with the fourth section initially causes the fourth section to pivot about the second section and continued pivotal movement causes the leg of the first section to pivot to a folded position parallel to the first section when the first section is parallel to and over the second section. Initial pivotal movement of the third section about its connection with the fifth section initially causes the fifth section to pivot about the third section and continued pivotal movement causes the leg of the second section to pivot to a folded position parallel to the second section when the second section is parallel to the third section, with the first section between and parallel to both, thereby to form a compact arrangement within the sofa frame beneath the seat thereof.

The above, and other objects, features and advantages of this invention will be apparent in the following detail description of an illustrative embodiment thereof, which used to read in connection with the accompanying drawings, wherein:

DESCRIPTION OF THE DRAWINGS

FIG. 4 is a side view similar to FIG. 3 showing a further portion of the folding operation; and FIG. 5 is a side view similar to FIGS. 3 and 4 showing the mechanism in its fully folded position.

DETAILED DESCRIPTION

Figures 1, 2:
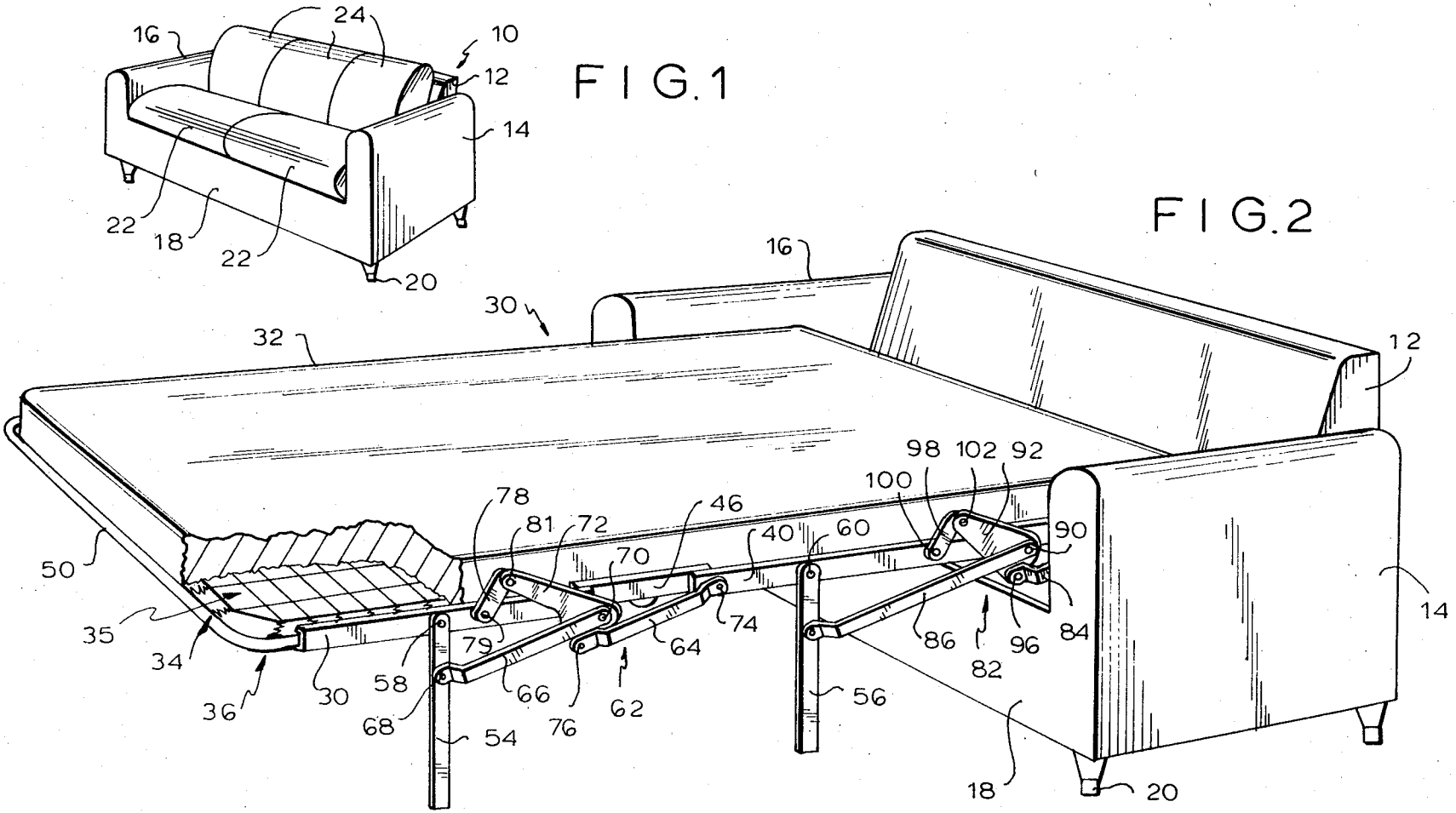
FIG. 1 is a perspective view of a convertible sofa-bed constructed in accordance with the present invention, with the mechanism thereof folded up in the sofa frame to permit the sofa to be used as a sofa.
FIG. 2 is a perspective view, partially broken away, of the sofa-bed of FIG. 1 unfolded for use as a bed.

Referring now to the drawing in detail, and initially to FIG. 1 thereof, the sofa-bed 10 constructed in accordance with the present invention is shown ready for use as a sofa. The sofa-bed includes a back 12, sides 14, 16, a front portion 18, and legs 20. Three loose back cushions 24 and two loose seat cushions 22 are also provided. The front, sides and back of the sofa are formed with an internal wooden structural frame (not seen in FIG. 1) in the conventional manner to form the main support structure for the sofa and for the sofa-bed mechanism contained therein.

When converting the sofa into a bed, the seat cushions 22 and the back cushions 24 are removed (although it is not necessary with the present invention that the back cushions be removable) to expose the bed mechanism 30 of the present invention. The mechanism is lifted out of and unfolded from the sofa-bed frame to form a bed as shown in FIG. 2. The bed includes a mattress 32 on a mattress support structure or spring support 34. The spring support 34 includes a spring assembly 35 of conventional construction formed of a plurality of crossing wires tensioned at their ends by springs connected to a support mechanism frame 36.

In the illustrative embodiment of the invention the mechanism 30 is designed particularly to accommodate an air-inflatable mattress. Preferably the mattress is inflated automatically upon operation of the mechanism 30 to the unfolded position, shown in FIG. 2, and is automatically partially evacuated, upon return of the mechanism to its folded position shown in FIG. 5. The inflation and deflation of the mattress 32 are within the scope of those skilled in the art, and form no part of the present invention. Therefore, that process is not described in detail.

The convertible sofa mechanism 30, and particularly, its frame 36 has five sections pivotally associated with each other to permit the mechanism to be folded and unfolded. As seen most clearly in FIGS. 3–5, there are three main sections: a first section 38, near the foot of the bed; a second section 40 near the center of the bed; and a third section 42 near the head of the bed, above the wooden support frame 44 in sofa 10. The first and second main frame sections are connected by a fourth shorter section 46 while the second and third frame sections are connected by a fifth shorter section 48 therebetween. The elements 38, 40, 42, 46 and 48 are provided on each side of the bed, interconnected by cross frame elements, such as seen in FIG. 2 at the foot of the bed, wherein the frame elements 38 on opposite sides are connected by the cross piece 50. The mechanism on the opposite side of the sofa-bed, not shown in FIG. 2, is a mirror image of the one illustrated. Because of this mirror image relationship, only one side of the sofa-bed mechanism is illustrated and described, since the operation of the other will be identical both structurally and functionally, as will be readily apparent to those skilled in the art.

The third mechanism section 42 is moveably supported on frame 44 by a support linkage means 52 of conventional construction. This linkage means is illustrated schematically in the drawing and is of generally conventional known construction. The linkage supports the head or third section 42 of the mechanism in a raised position, illustrated in FIG. 3 in the unfolded condition of the sofa-bed mechanism and serves to move it downwardly into a parallel but lower position, illustrated in FIG. 5, in the folded position of the sofa-bed mechanism. In the illustrative embodiment, a simple pivot linkage is shown, but a more conventional linkage, such as shown for example in U.S. Pat. No. 3,934,281 could be used instead.

In the unfolded condition of the sofa-bed, the mechanism 30 is supported on legs 54, 56, with mirror image legs being located on the opposite side of the frame. The legs 54 are pivotally connected at 58 in any convenient manner to first section 38, while legs 56 are pivotally connected at 60 to the middle or second section 40 of the mechanism.

The first and second sections of the sofa-bed mechanism are connected to each other and also to legs 54 by a control linkage mechanism 62, which also is duplicated on the opposite side of the sofa-bed. This linkage mechanism serves to aid in folding and unfolding of the frame sections during operation of the sofa-bed mechanism. The control linkage 62 includes a pair of sub-links 64, 66 which, in the unfolded position of the mechanism, illustrated in FIG. 2 extend generally parallel to each other. The link 66 has one end 68 pivotally connected to leg 54 and the opposite end thereof pivotally connected at 70 to a control plate 72. The link 64 is pivotally connected at one end 74 thereof to the middle or second section 40 and its opposite end 76 is pivotally connected to control plate 72 at a point below and slightly forward of the point 70 (i.e. slightly more towards the free or foot end of the mechanism).

The sub-linkage 62 also includes an over-the-center link 78 pivotally connected at one end 79 to the first section 30 and at the opposite end 81 to control plate 72, such that in the unfolded position of the mechanism, as illustrated in FIG. 2, the point of connection 81 of the over-the-center link and the control plate is located between and above the points of connection of section 30 to the over-the-center link and to section 46.

Figure 3:
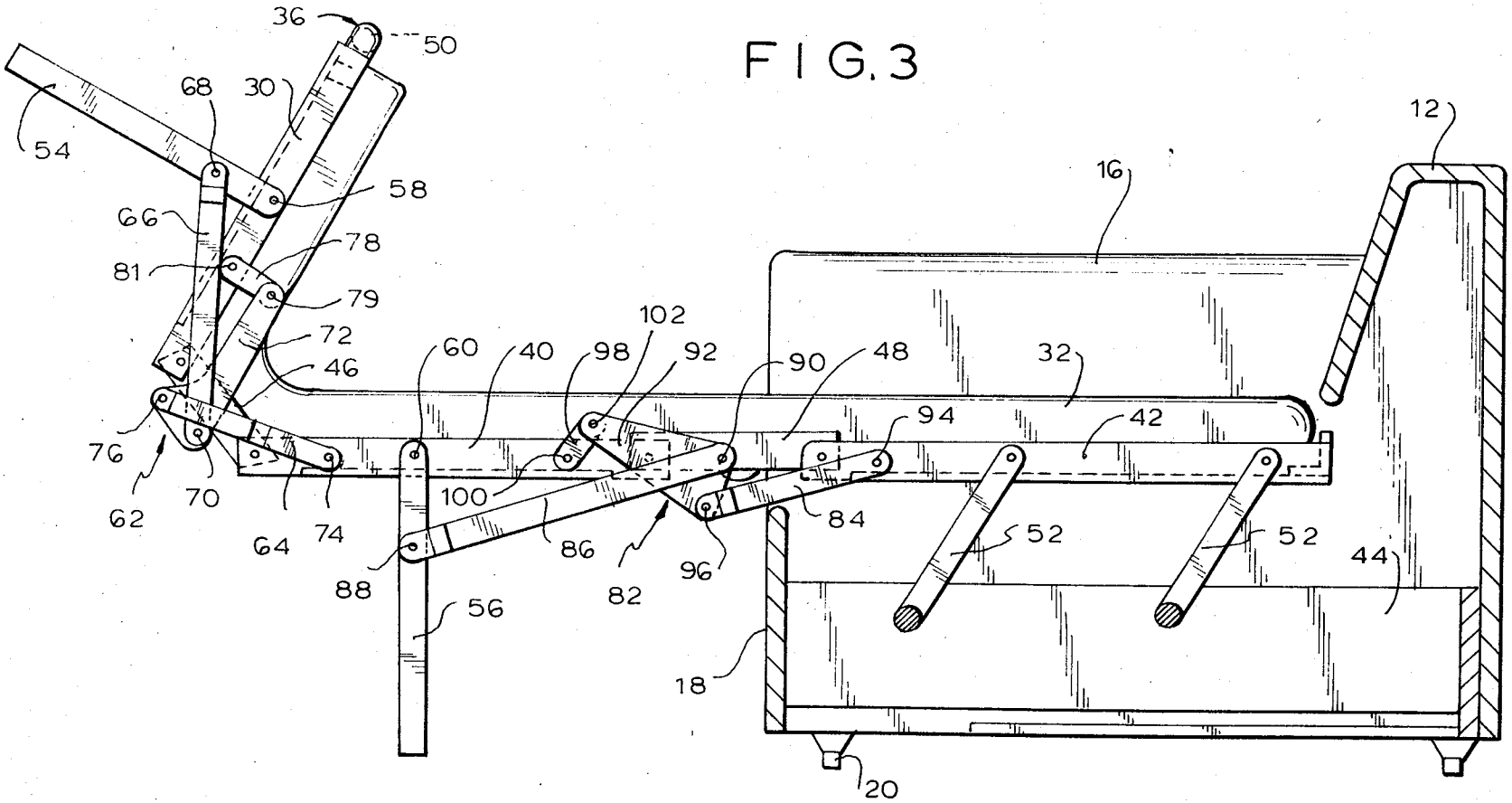
FIG. 3 is a side view with parts broken away of the sofa-bed of FIG. 2, showing an initial step of the folding operation.

With this construction, when section 30 is initially pivoted from the opened position of FIG. 2 to the closed position, as illustrated in FIG. 3, initial pivotal movement of the first section about its connection with the fourth section 46 initially causes that fourth section to pivot about the second section 40, while continued pivotal movement causes leg 54 to pivot to a folded position parallel to section 30 when the section 30 is parallel to and over the second section 40 (see FIG. 4). In this folded position, links 64, 66 cross each other and the link 78 "moves over center" (so that point 81 is below the plane of section 30) to releasably lock the mechanism in the folded position and hold the mattress compressed.

The mechanism 30 also includes a second sub-linkage 82, which is substantially identical to linkage 62 in construction and operation. This linkage includes, as seen most clearly in FIG. 3, a pair of links 84, 86 respectively. The link 86 is pivotally connected at one end 88 to leg 56, and at its opposite end is pivotally connected at 90 to a control plate 92. The link 84 is connected at 94 to the third section 42, while it is pivotally connected at 96 to control plate 92. As seen in FIG. 3, in the unfolded position of the mechanism links 84, 86 are generally parallel to each other with the pivotal connection 96 located below and forwardly of pivotal connection 90. In addition, an over-the-center link 98 is also provided pivotally connected at one end 100 to section 40 and at its opposite end to control plate 92 such that again, in the unfolded position of the mechanism, the pivotal connection 102 therebetween is located above the level of the section 40 between the points of connection of section 40 to the over-the-center link and to section 48.

With this construction, continued folding of the mechanism, from the position illustrated in FIG, 3 through the position illustrated in FIG. 4, causes the second section 40 to initially pivot about the fifth section 48 and continued pivotal movement causes leg 56 to pivot to a folded position parallel to second section 40 when the second section is parallel to and above the third section. Ultimately, as seen in FIG. 5, the first section of the mechanism is located between the second and third sections in a generally parallel relationship between the sections within the confines of the frame 44, below the seating area of the sofa. The second section 40 and its associated portion of spring 34 thus form the seating surface upon which the cushions 22 can be placed. As a result, a relatively compact mechanism is provided which is contained entirely within frame 44, without the need for occupying additional space in the rear or back of the sofa. Thus, the sofa mechanism permits the sofa to be constructed in a more natural dimensional relationship corresponding to the dimensions of conventional sofas.

Although an illustrative embodiment of the invention has been described herein with reference to the accompanying drawings, it is to be understood that various changes and modifications may be effected therein by one skilled in the art without departing from the scope or spirit of this invention.

What is claimed is:

1. In a convertible sofa-bed having a mechanism support frame, a folding mechanism for supporting a mattress when unfolded and for supporting a seat when folded with the mechanism located within the frame below the seat; said mechanism having first, second and third main sections, a shorter fourth section pivotally interconnecting said first and second sections, and a shorter fifth section pivotally interconnecting said second and third sections, support linkage means for movably supporting said third section within said frame for movement between a first position in the unfolded position of the mechanism and a second position lower in said frame than said first position in the folded position of the mechanism with said first and second sections folded above the third section within the frame; leg means respectively pivotally connected to said first and second sections and a linkage mechanism for folding and unfolding said frame sections including a pair of sub-linkages each of which includes first and second control links extending generally parallel to, but offset from each other, in the unfolded position of the mechanism and crossing each other in the folded position, and a control plate associated with each of said sub-linkages; the first control link in one of said pairs being pivotally connected at one end to the leg means of said first section and at its other end to its associated control plate in proximity to said fourth section, the second control link of that pair being pivotally connected at one end to its associated control plate such that in the unfolded position of the mechanism said one end thereof is below the first link and closer to said leg means of the first section than said other end of the first link; the first control link in the other of said pairs of sub-linkages being pivotally connected at one end to the leg means of said second section and at its other end to its associated control plate in proximity to said fifth section, the second control link of that pair being pivotally connected at one end to its associated control plate such that in the unfolded position of the mechanism said one end thereof is below the first link and closer to said leg means of the section than said other end of first link; said sub-linkages each also including an over-the-center link respectively pivotally connected at one end to the first and second sections between their associated leg means and the pivotal connections of said fourth and fifth sections to the first and second sections; the opposite ends of said over-the-center links being respectively connected to the control plates of their respective sub-linkages such that in the unfolded position of the mechanism the points of connection of the over-the-center links and their associated control plates are located between and above the points of connection of the over-the-center links and their respective sections and shorter sections, whereby initial pivotal movement of said first section about its connection with said fourth section initially causes said fourth section to pivot about the second section and continued pivotal movement causes the leg means of the first section to pivot to a folded position parallel to the first section when the first section is parallel to and over the second section and thereafter, continued pivotal movement of said third section abouts its connection with said fifth section initially causes said fifth section to pivot about the third section and continued pivotal movement causes the leg means of the second section to pivot to a folded position parallel to the second section when the second section is parallel to the third section and with said first section between and parallel to both, thereby to form a compact arrangement within the sofa frame beneath the seat thereof.

2. In a convertible sofa-bed as defined in claim 1 wherein said fourth and fifth sections each comprise a pair of side rails on opposite sides of the mechanism and a cross bar interconnecting each of said rails.

3. In a convertible sofa-bed as defined in claim 2 wherein said fourth and fifth sections include cooperating means for engaging said first, second and third sections to limit relative pivotal movement beyond said folded and unfolded positions.

4. In a convertible sofa-bed having a seating area, a back rest and a mechanism support frame located below said seating area, a folding mechanism for supporting a mattress when the mechanism is unfolded and for supporting a seat in said seating area when folded with the mechanism located within the frame below the seat; said mechanism having first, second and third main sections, a fourth auxiliary section pivotally interconnecting said first and second sections, a fifth auxiliary section pivotally interconnecting said second and third sections; means operatively engaged with said third section for supporting said mechanism in said support frame; leg means respectively pivotally connected to said first and second main sections, and a linkage mechanism for folding and unfolding said frame sections including first and second substantially identical sub-linkages, said first sub-linkage being connected between said first and second main frame sections and said second sub-linkage being connected between said second and third main frame sections, said first sub-linkage including means for pivoting said fourth frame section about the second frame section upon pivotal movement of the first frame section with respect to the fourth frame section from the unfolded position of the mechanism toward the folded position and for pivoting the leg means associated with said first frame section to a folded position parallel to the first section when the first section is parallel to an over the second frame section; said second sub-linkage including means for pivoting said fifth frame section about the third frame section upon pivotal movement of the second frame section with respect to the fifth frame section from the unfolded position of the mechanism toward the folded position and for pivoting the leg means associated with said second frame section to a folded position parallel to the second section when the second section is parallel to the third section, with the first section between and parallel to both, thereby to form a compact arrangement within the sofa frame beneath the seat thereof.

5. In a convertible sofa-bed as defined in claim 4 wherein said sub-linkages each include a pair of control links extending generally parallel to each other in the unfolded position of the mechanism and crossing each other in the folded positions, and each of which is pivotally connected at one end to one of the main frame sections associated with the sub-linkage; and a control plate adjacent the auxiliary frame section between the main frame sections associated with the sub-linkage, said control links each having opposite ends pivotally connected adjacent each other to said control plate.

6. In a convertible sofa-bed as defined in claim 5 wherein said fourth and fifth sections each comprise a pair of side rails on opposite sides of the mechanism and a cross bar interconnecting each of said rails.

7. In a convertible sofa-bed as defined in claim 6 wherein said fourth and fifth sections include cooperating means for engaging said first, second and third sections to limit relative pivotal movement beyond said folded and unfolded positions.

* * * * *